US009777911B2

(12) United States Patent
Duckworth

(10) Patent No.: US 9,777,911 B2
(45) Date of Patent: Oct. 3, 2017

(54) MODULAR AREA LUMINAIRE

(71) Applicant: Hubbell Incorporated, Shelton, CT (US)

(72) Inventor: Jason Duckworth, Simpsonville, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/984,720

(22) Filed: Dec. 30, 2015

(65) Prior Publication Data

US 2016/0320035 A1 Nov. 3, 2016

Related U.S. Application Data

(60) Provisional application No. 62/155,189, filed on Apr. 30, 2015.

(51) Int. Cl.

| | |
|---|---|
| ***F21V 21/116*** | (2006.01) |
| ***F21V 29/00*** | (2015.01) |
| ***F21V 29/76*** | (2015.01) |
| *F21Y 101/02* | (2006.01) |
| *F21W 131/10* | (2006.01) |

(52) U.S. Cl.

CPC ..... *F21V 21/116* (2013.01); *F21V 29/76* (2015.01); *F21W 2131/10* (2013.01); *F21Y 2101/02* (2013.01)

(58) Field of Classification Search

CPC ..... F21V 21/116; F21V 29/76

See application file for complete search history.

(56) References Cited

U.S. PATENT DOCUMENTS

| | | | |
|---|---|---|---|
| 4,426,676 | A | 1/1984 | Taylor |
| 5,000,535 | A | 3/1991 | Churchill |
| 7,226,047 | B1 | 6/2007 | Beauchamp |
| 2009/0251898 | A1 | 10/2009 | Kinnune et al. |
| 2013/0215606 | A1 | 8/2013 | Wang et al. |

FOREIGN PATENT DOCUMENTS

| | | |
|---|---|---|
| EP | 2600055 | 6/2013 |

OTHER PUBLICATIONS

PCT/US2015/068120 International Search Report and Written Opinion dated Feb. 26, 2016.

*Primary Examiner* — Thomas M Sember

(74) *Attorney, Agent, or Firm* — Michael Best & Friedrich, LLP

(57) ABSTRACT

A luminaire includes a housing having a rear section, a middle section removably connected to the rear section and, a front section removably connected to the middle section. A control component is positioned in the rear section. A light emitter assembly is operably connected to the control component.

20 Claims, 9 Drawing Sheets

MODULAR AREA LUMINAIRE

RELATED APPLICATION(S)

This application is based on U.S. Provisional Application Ser. No. 62/155,189, filed Apr. 30, 2015, the disclosure of which is incorporated herein by reference in its entirety and to which priority is claimed.

FIELD

Various exemplary embodiments relate to light fixtures or luminaires, for example external area light fixtures designed to illuminate streets, paths, parking lots, or other areas.

BACKGROUND

Light fixtures, or luminaires, are used with electric light sources to provide an aesthetic and functional housing in both interior and exterior applications. One type of light fixture is an area light, generally used for exterior lighting of roads, walkways, parks, parking lots, or other large areas requiring a significant amount of lighting. Area lights typically include a light fixture attached to a pole, wall, or other elevated structure to provide an elevated lighting position. In recent years, lighting applications, including area lights have trended towards the use of light emitting diodes (LEDs) as a light source in place of conventional incandescent and fluorescent lamps.

SUMMARY

According to an exemplary embodiment, a luminaire includes a housing having a rear section, a middle section removably connected to the rear section and, a front section removably connected to the middle section. A control component is positioned in the rear section. A light emitter assembly is operably connected to the control component.

According to another exemplary embodiment, a luminaire includes a housing having a rear section and a removable front section. A control component is positioned in the rear section. A channel extends from the rear section to the front section. A conductor conduit extends through the channel. A light emitter assembly is operably connected to the control component through the conductor conduit.

According to another exemplary embodiment, a luminaire includes a support, a housing, and a light emitter. The housing includes a mounting feature having a first fastener boss and a second fastener boss to connect the housing to the support. The light emitter is connected to the housing.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
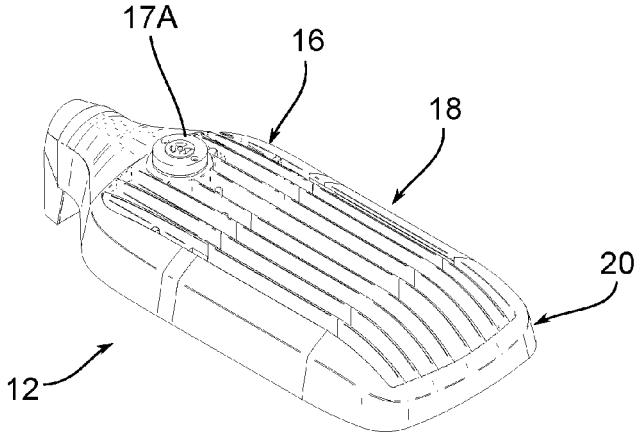
FIG. 1 is a top, front perspective view of an exemplary luminaire.
Figure 2:
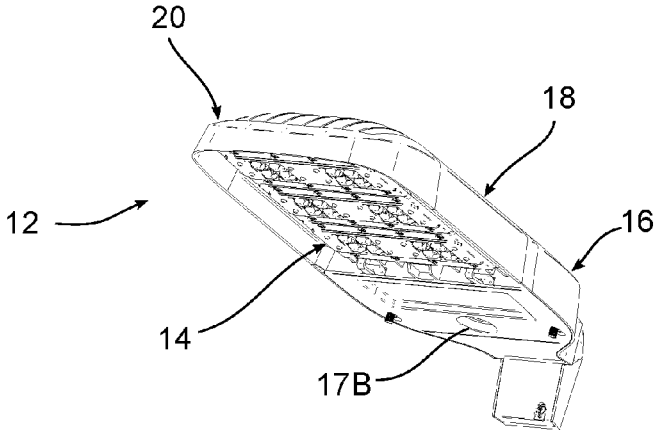
FIG. 2 is a bottom, front perspective view of FIG. 1.
Figure 3:
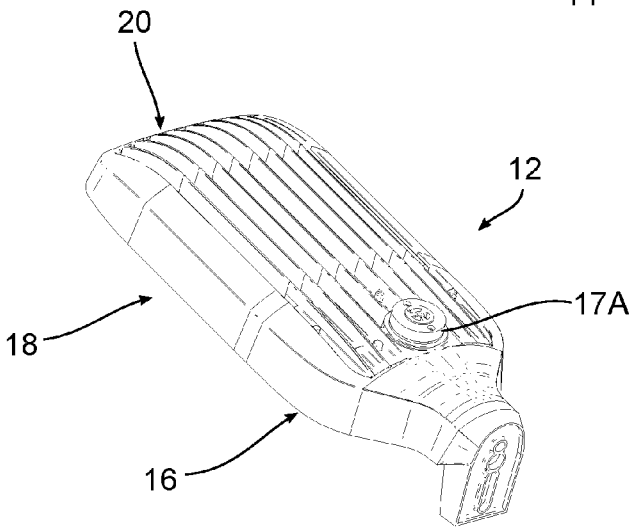
FIG. 3 is a top, rear perspective view of FIG. 1.
Figure 4:
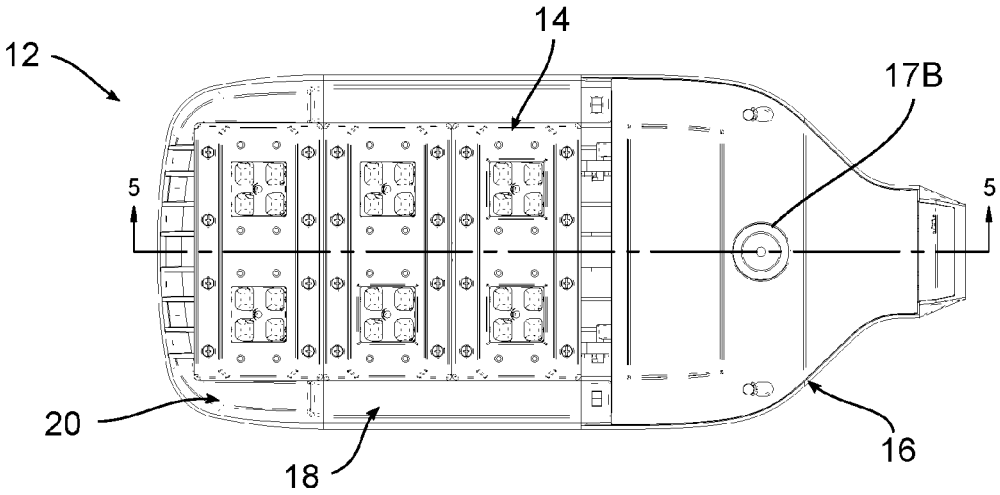
FIG. 4 is a bottom view of FIG. 1.
Figure 5:
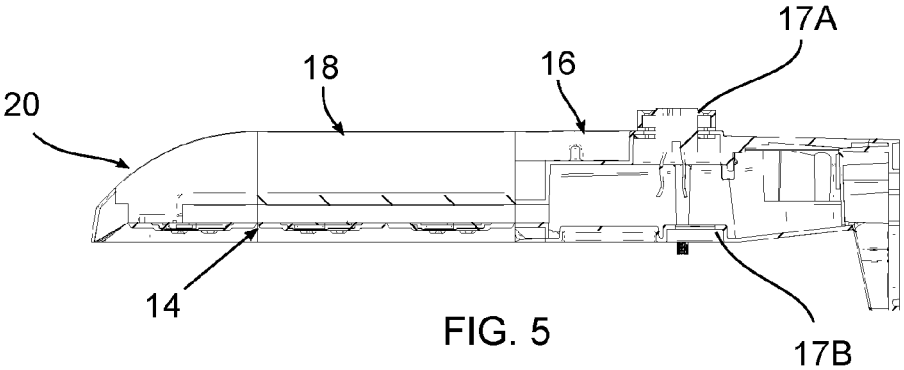
FIG. 5 is a sectional view of FIG. 4 taken along line 5-5.
Figure 6:
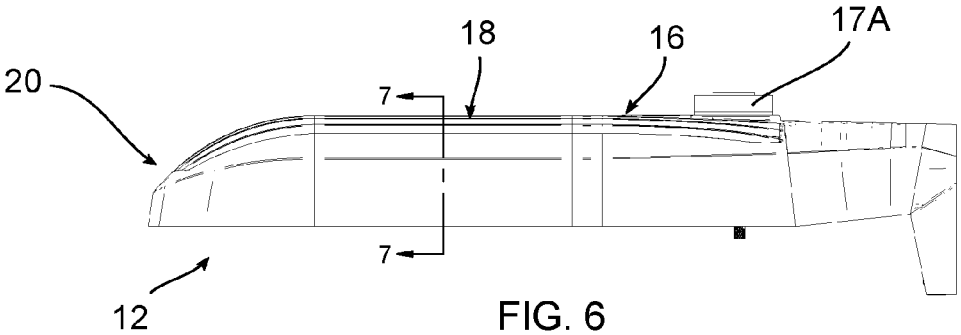
FIG. 6 is a right side view of FIG. 1.
Figure 7:
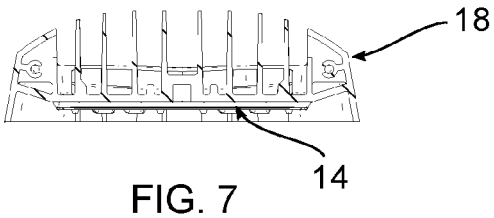
FIG. 7 is a sectional view of FIG. 6 taken along line 7-7.

According to various exemplary embodiments, a luminaire 10 includes a housing 12 containing one or more light emitter assemblies 14 and one or more control components for controlling light emitters. The housing 12 includes a rear section 16, a middle section 18, and a front section 20. In various exemplary embodiments the housing 12 is made from aluminum, although other metal, polymer, or composite materials may also be used. A lens, diffuser, or other cover (not shown) may be connected to the housing positioned beneath the light emitters. The housing 12 can have various shapes, sizes, and configurations as needed.

The rear section 16 includes a compartment housing the control components. The control components can include various combinations of drivers, surge protectors, and sensors. In the exemplary embodiment shown, a photocell or light sensor 17A extends from the top of the rear section and an occupancy sensor 17B extends from the bottom of the rear section. Other types of sensors and other electronic components and circuitry can be used to control the light emitter assemblies as would be understood by one of ordinary skill in the art. The rear section 16 can also include brackets or other structure to connect and/or support the control components.

Figure 8:
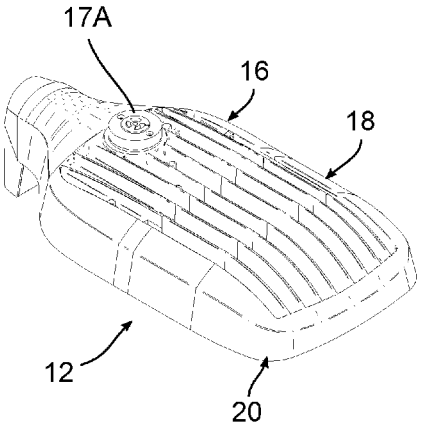
FIG. 8 is a top, front perspective view of the luminaire of FIG. 1 with a shorter middle section.
Figure 10:
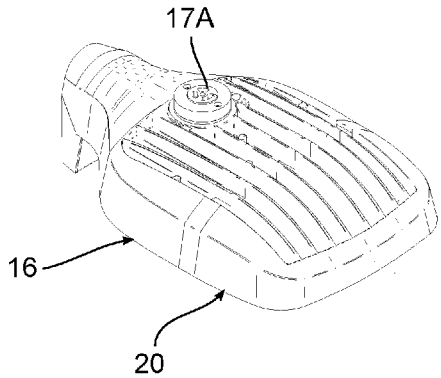
FIG. 10 is a top, front perspective view of the luminaire of FIG. 1 without a middle section.
Figure 9:
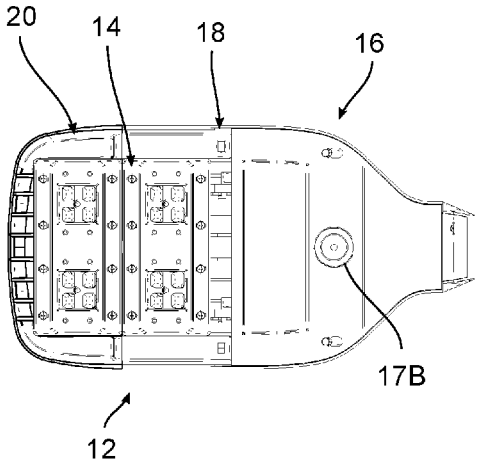
FIG. 9 is a bottom view of FIG. 8.
Figure 11:
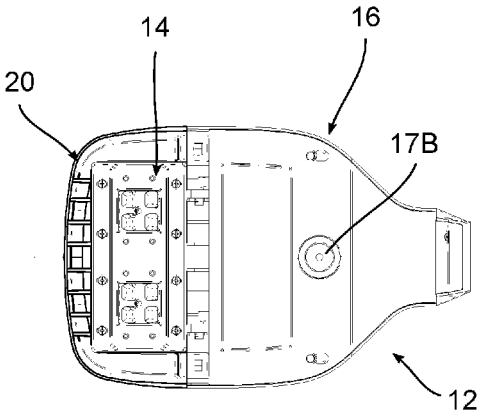
FIG. 11 is a bottom view of FIG. 10.

In an exemplary embodiment, the size of the housing 12 is adjustable to fit a desired size, design, or light output. FIGS. 1-7, show an exemplary housing having a front section 20 that accommodates a single light emitter assembly 14 and a middle section 18 that accommodates two light emitter assemblies 20. FIGS. 8 and 9 show an exemplary housing 12 having a front section 20 that accommodates a single light emitter assembly 14 and a middle section 18 that accommodates a single light emitter assembly 14. FIGS. 10 and 11 show an exemplary housing having a front section 20 that accommodates a single light emitter assembly 14 that is connected to the rear section 16 and the middle section 18 is omitted. Other embodiments can incorporate longer middle sections 18 or multiple middle sections 18 to include more light emitter assemblies 14.

Figure 12:
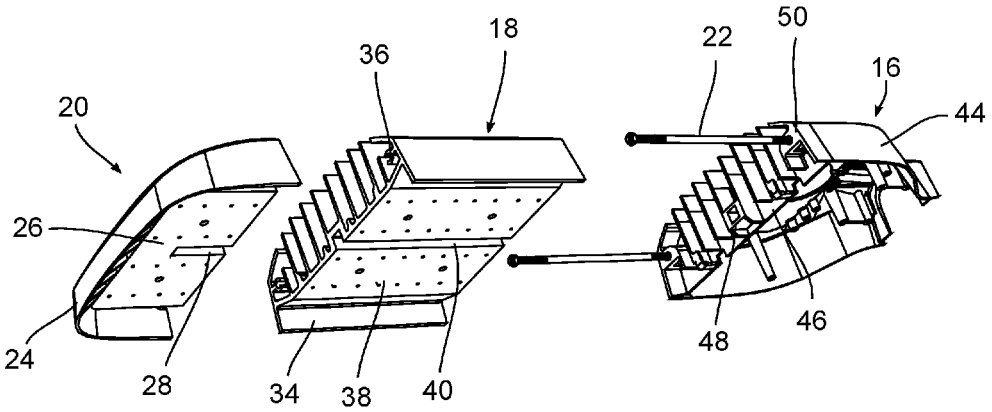
FIG. 12 is an exploded view of an exemplary rear, middle, and front section.

FIG. 12 shows an example of a method of connecting the rear, middle, and front sections 16, 18, 20 using first and second bolts 22. The bolts 22 can be connected to the rear section 16, for example with a first set of nuts. The middle and front sections 18, 20 can then be slid onto the bolts 22 and secured with a second set of nuts. Different length bolts 22 can be used depending on the size and number of housing sections used.

Figure 13:
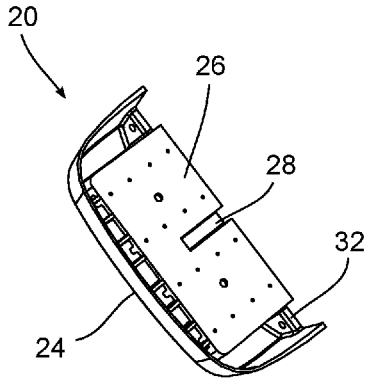
FIG. 13 is a bottom, front perspective view of the front section of FIG. 12.
Figure 14:
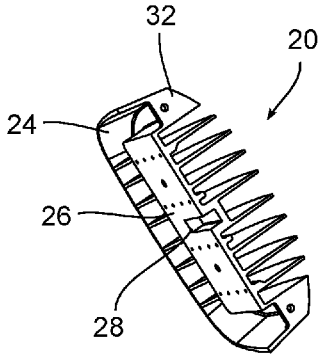
FIG. 14 is a bottom, rear perspective view of FIG. 13.

FIGS. 12-14 best show an exemplary embodiment of the front section 20 that includes a side wall 24 extending substantially along three sides enclosing a mounting portion 26. The mounting portion 26 includes one or more openings to receive fasteners to attach a light emitter assembly 14 and a channel 28 to receive a conductor conduit 30. One or more fins extends above the mounting portion 26 to dissipate heat from the light emitter assembly. A pair of rear walls 32 each include an opening to receive the first and second bolts 22, respectively. After the front section 20 is connected to the bolts 22 the second set of nuts can be threadably connected to the front portion of the bolts 22.

Figure 15:
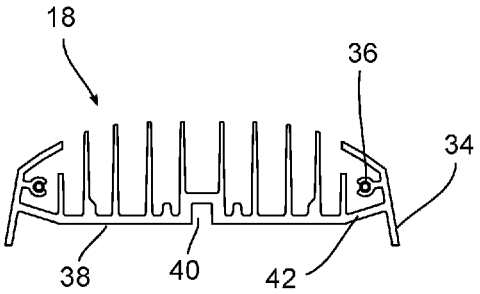
FIG. 15 is a front view of the middle section of FIG. 12.

FIGS. 12 and 15 show an exemplary embodiment of the middle section 18 that includes first and second side walls 34 extending along the length of the middle section 18. The side walls 34 have first and second angled portions and a projection 36 extending from each side wall 34 to receive the first and second bolts 22, respectively. In an exemplary embodiment, the projections 36 include a substantially C-shaped member. A mounting portion 38 is positioned between the side walls 34 to receive a light emitter assembly 14. The mounting portion 38 includes one or more openings to receive fasteners to attach one or more light emitter assemblies 14 and a channel 40 to receive a conductor conduit 30. First and second angled portions 42 connect the mounting portion 38 to the first and second walls 34, respectively. The first and second angled portions 42 connect the mounting portion 38 more toward the center of the side walls 34 to help dissipate heat more evenly through the side walls 34. One or more fins are thermally connected to the mounting portion to dissipate heat from the light emitter assemblies 14. The fins closest to the sidewalls 34 are spaced from the top angled portions of the side walls 34 to provide enhanced air circulation.

Figure 16:
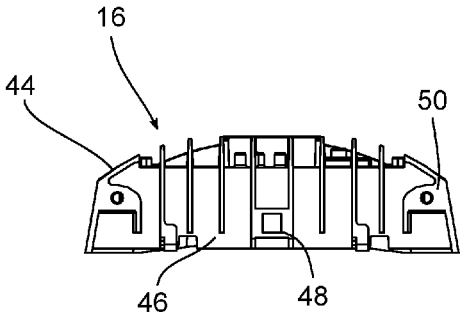
FIG. 16 is a front view of the rear section of FIG. 12.
Figure 17:
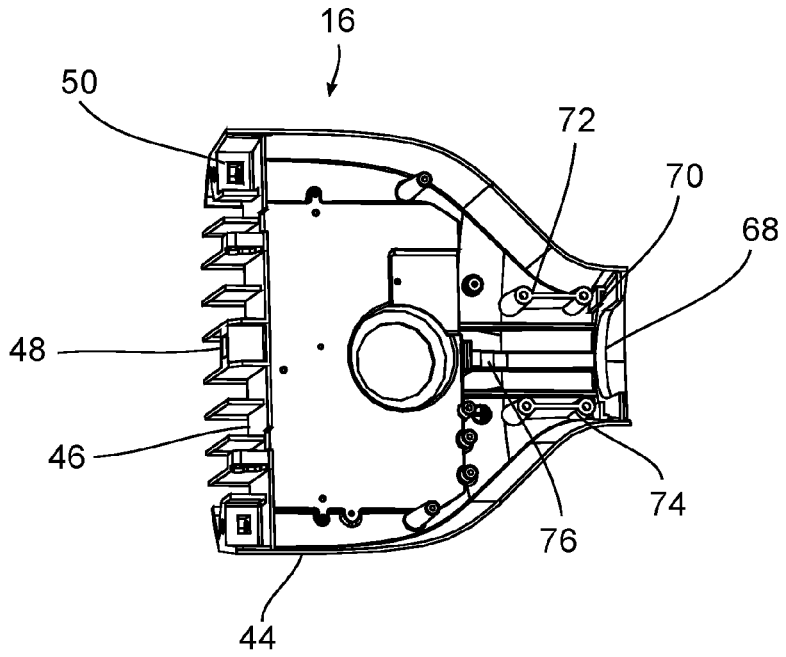
FIG. 17 is a bottom perspective view of the rear section of FIG. 12.

FIGS. 12, 16, and 17 show an exemplary embodiment of the rear section 16. The rear section 16 includes a pair of side walls 44 and a partition wall 46 that separates the compartment. A central opening 48 is provided to receive the conduit 30. The central opening 48 can extend through the partition wall 46 so that conductors can be passed from the compartment to the rest of the housing 12. The rear section 16 includes first and second chambers 50 having an opening for receiving the first and second bolts 22. A nut can be placed in each of the chambers 50 to threadably connect to the first and second bolts, respectively. In an exemplary embodiment, the chambers 50 can be shaped to receive the nut so that it cannot rotate. For example, the chambers 50 can have angled walls corresponding to a hexagonal nut. The rear section 16 includes one or more fins for dissipating heat.

Figure 18:
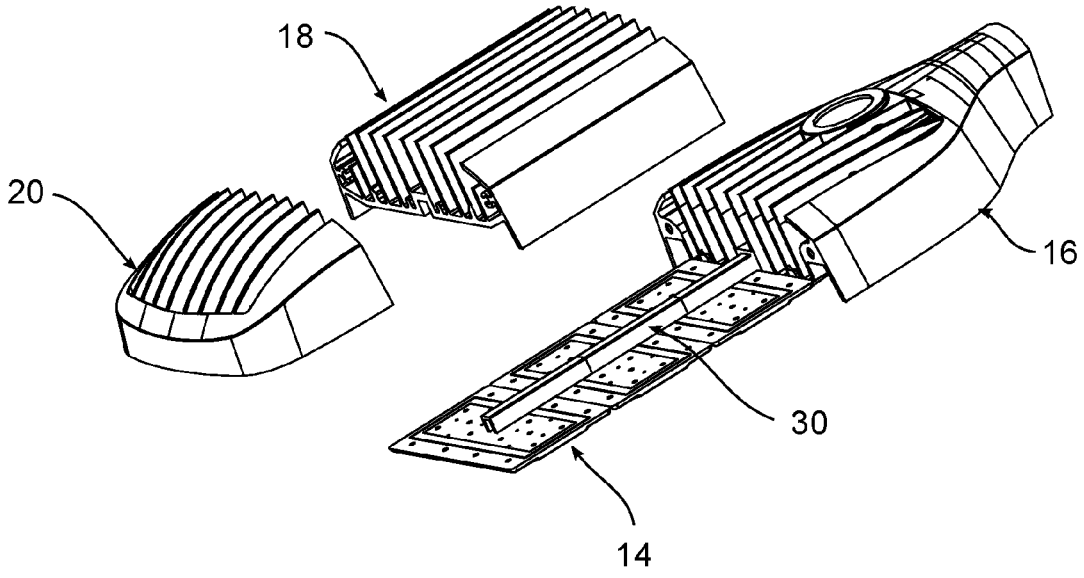
FIG. 18 is a partially exploded view of a the rear, middle, and front section and an exemplary conduit and light emitter assembly.
Figure 19:
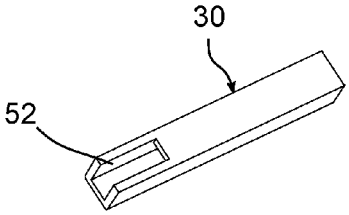
FIG. 19 is a perspective view of the conduit of FIG. 18.
Figure 21:
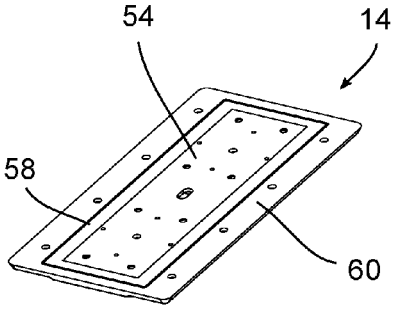
FIG. 21 is a top perspective view of FIG. 20.

As best shown in FIG. 18, a conduit 30 extends from the rear portion 16 to the front portion 20 and is received in the central opening 48 and the respective channels 28, 40. In the exemplary embodiment, the conduit 30 is a square tube made from one or more pieces. The conduit 30 can be made from an elastomeric material, such as silicone, to seal conductors passing from the compartment to the light emitter assemblies 14. As best shown in FIG. 21, the conduit 30 can include an opening 52 that is positioned over or near the light emitter assemblies 14. A single conduit 30 can be used that is formed to different lengths depending on the size of the housing configuration, or different sized conduits 30 can be made that are associated with each housing piece.

Figure 20:
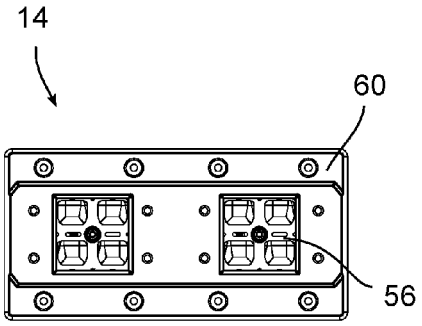
FIG. 20 is a bottom view of the light emitter assembly of FIG. 18.
Figure 22:
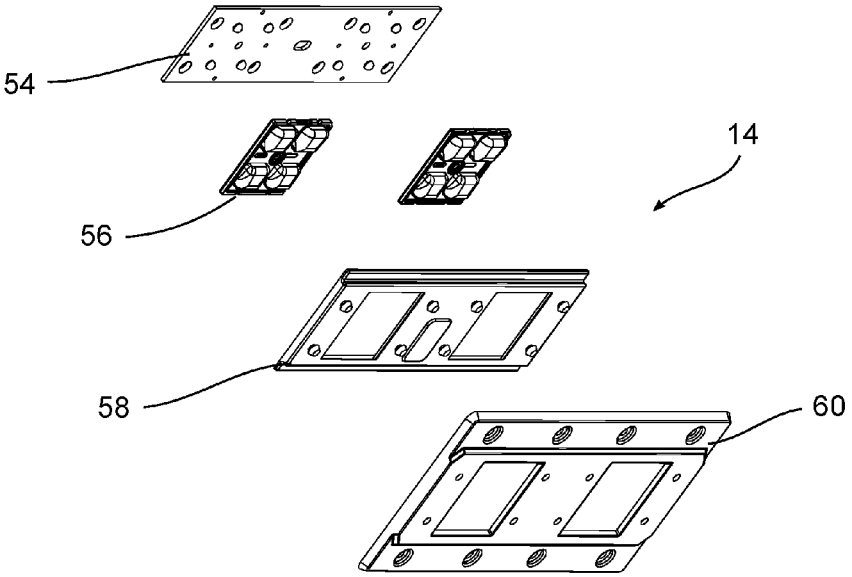
FIG. 22 is an exploded view of FIG. 20.

FIGS. 20-22 show an exemplary embodiment of the light emitter assembly 14 that includes an LED board 54, a pair of optics 56, a gasket 58, and a bezel 60. The LED board 54 includes one or more LEDs connected to a printed circuit board. The optic 56 can be connected to the printed circuit board, for example by one or more fasteners, or held in place by the gasket 58 and/or bezel 60. If the optic 56 is held in place by the gasket 58 and/or bezel 60, a plug may be provided to help seal the optic 56 where a fastener would otherwise be present. The gasket 58 can overlap the edges of the LED board 54 and the optics 56. The gasket 58 can include one or more protrusions extending toward the bezel 60 to help cushion the bezel 60 and retain the gasket 58 in place. The bezel 60 can have a recessed portion for receiving the LED board 54, optic 56, and gasket 58 so that the rear of the assembly has a substantially planar surface. In an exemplary embodiment, one or more fasteners connect the LED board 54 to the bezel 60 and one or more fasteners connect the bezel 60 to a mounting portion of one of the housing components.

Various exemplary embodiments are directed to methods of combining different housing sections to create luminaires of different sizes and with different light outputs. In an exemplary embodiment, each light emitter assembly 14 is capable of producing 5 k lumens so that luminaires in increments of 5 k lumens can be assembled as desired.

Figure 23:
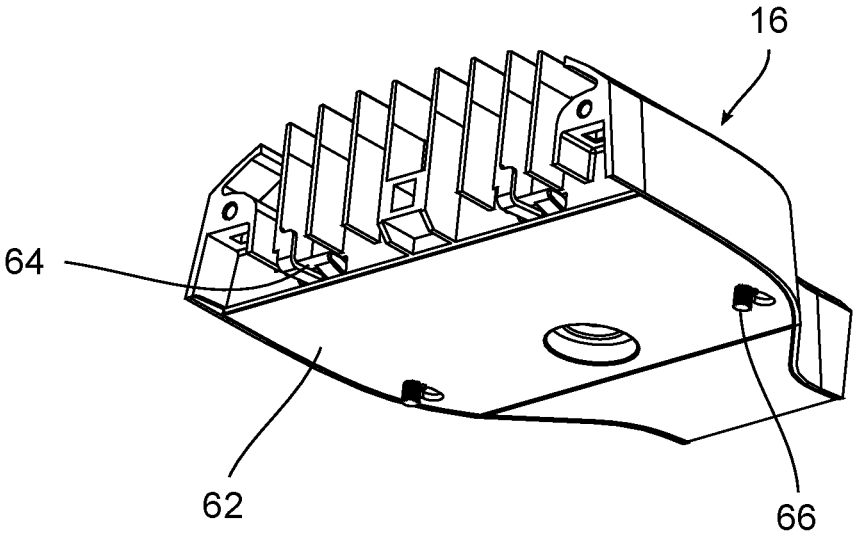
FIG. 23 is a bottom perspective view of the rear section and a door.
Figure 24:
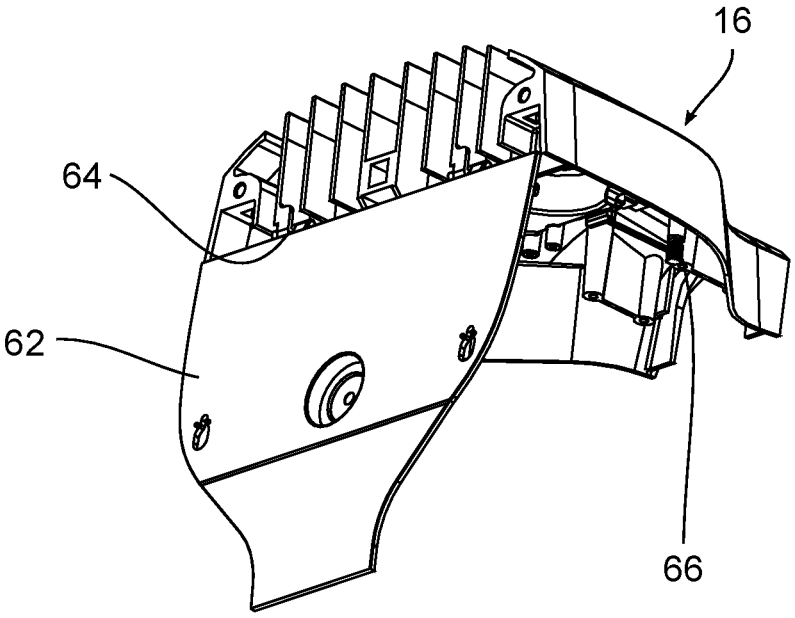
FIG. 24 shows the door of FIG. 23 in an open position.

FIGS. 23 and 24 show an exemplary door 62 pivotably connected to the rear section 16. The door 62 can include an opening for a sensor, for example a movement or occupancy sensor. A first hinge member 64 on the door 62 connects to a second hinge member on the rear section 16. For example, the door includes a pair of arms and hinge pins extending from the arms that pivotally connect to the rear section 16. A pair of keyhole slots each receive a fastener 66, for example a knurled thumb screw. The fasteners 66 can be loosened and the door 62 slid toward the front of the housing 12 and pivoted into an open position.

FIG. 17 also shows mounting features associated with the rear section 16 for attaching the housing 16 to different types of supports. The mounting features can include a rear opening, for example a substantially U-shaped opening 68, a slot 70 positioned proximate the opening 68, a first pair of bosses 72 positioned on one side of the opening, and a second pair of bosses 74 positioned on another side of the opening. The rear section 16 can also include one or more protrusions 76 that are positioned to act as a stop for different mounting structures. For example the protrusions 76 can have a different heights in a step-like pattern to receive different sized mounting structures.

Figure 25:
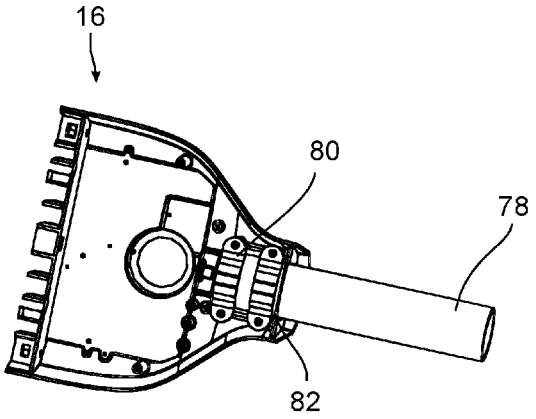
FIG. 25 is a bottom perspective view of the rear section connected to a first support.
Figure 26:
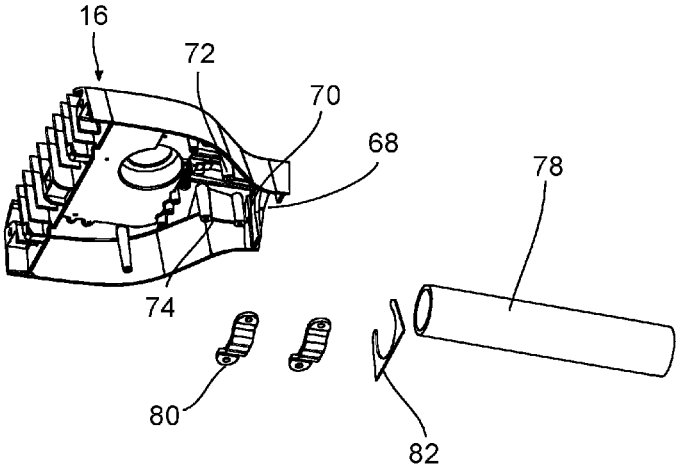
FIG. 26 is an exploded view of FIG. 25.

FIGS. 25 and 26 show the rear housing 16 connected to a first pole 78, for example a first roadway tenon that has a horizontal component used to position lights along streets or highways. First and second clamps 80 can be connected to the bosses 72, 74 to secure the housing 12 to the first pole 78. A shield 82 can also be positioned in the slot 70 and clip onto the pole 78 to block at least some of the excess space around the first pole 78.

Figure 27:
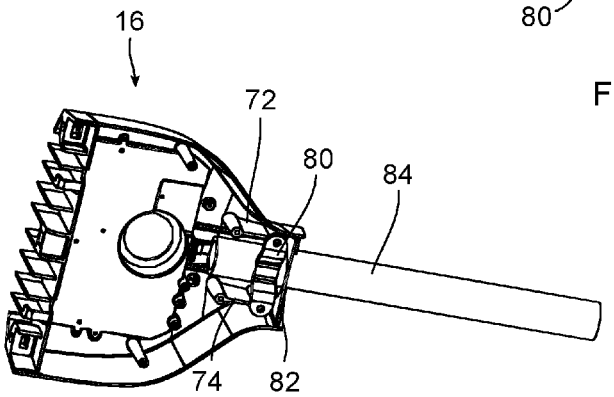
FIG. 27 is a bottom perspective view of the rear section connected to a second support.

FIG. 27 shows the rear housing 16 connected to a second pole 84, for example a second roadway tenon. The second pole 84 as shown has a smaller diameter than the first pole 78. First and second clamps 80 can be connected to the bosses 72, 74 to secure the housing 12 to the second pole 84. The shield 82 can also be positioned in the slot 70 and clip onto the second pole 84 to block at least some of the excess space around the second pole 84.

Figure 28:
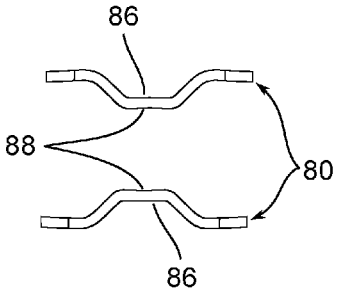
FIG. 28 is a front view of a pair of clamps.
Figure 29:
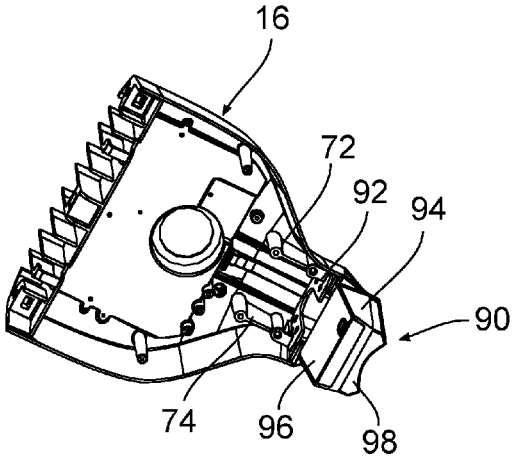
FIG. 29 is a bottom perspective view of the rear section connected to an exemplary mounting assembly.
Figure 30:
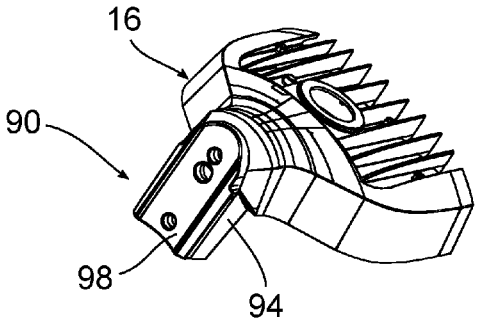
FIG. 30 is a rear, top perspective view of FIG. 29.
Figure 31:
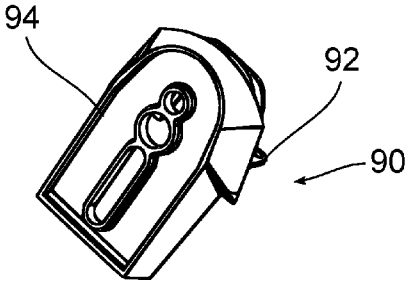
FIG. 31 is a rear perspective view of a mounting base and mounting plate.
Figure 32:
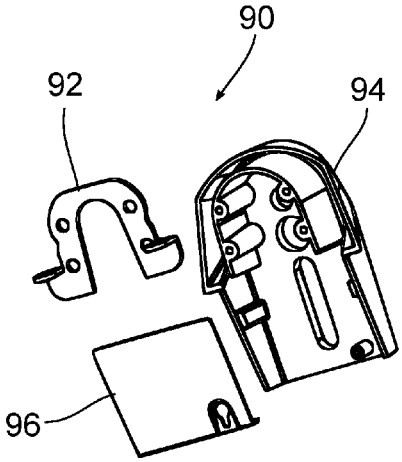
FIG. 32 is an exploded view of a mounting assembly.

As best shown in FIG. 28, the clamp 80 is configured to have a first supporting portion 86 on a first side and a second supporting portion 88 on a second side so that both the first and second sides can be used to support structures. The first supporting portion 86 can be used to support structures with a large size than capable of being supported by the second supporting 88 portion. In alternative embodiments, different clamps or other fasteners can be used.

FIGS. 29-32 show an exemplary mounting assembly 90 that is used to support the housing 12 on a substantially vertical structure, such as a wall, post, or pole. The mounting assembly 90 includes a mounting plate 92, a mounting base 94, a cover 96, and a curved adapter 98. The mounting plate 92 includes first and second arms that connect to the rear bosses 72, 74, for example through a pair of fasteners. One or more openings in the mounting plate 92 receive fasteners to connect the mounting plate 92 to the mounting base 94. The mounting base 94 includes one or more openings and a slot to receive fasteners to connect the mounting base 94 to a structure. The slot is provided so that the mounting base 94 can be connected to structures with different mounting positions. The slot or one of the openings can also be used to pass conductors through the mounting assembly 90. The cover 96 can be positioned over a portion of the mounting base 94. The cover 96 is selectively removable to allow access to a user, for example to connect or disconnect wires. The cover 96 has a keyhole slot. The curved adaptor 98 can be attached to the mounting base 94 to allow the mounting assembly 90 to be attached to a curved support structure.

In an exemplary embodiment the mounting base 94 is initially attached to a support structure and the mounting plate 92 is attached to the base 94. The rear section 16 is then slid onto the mounting plate 92 which is positioned in the slot 70. The mounting plate 92 is then secured to the rear section 16 with fasteners. In this way, the entire housing 12 does not need to be simultaneously supported and bolted to a support.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A luminaire comprising:

a housing rear section;

a housing middle section removably connected to the rear section;

a housing front section removably connected to the middle section and configured to connect to the rear section;

a first light emitter assembly connected to the front section;

a second light emitter assembly connected to the middle section; and a control component positioned in the rear section and operatively connected to the first and second light emitter assemblies.

2. The luminaire of claim 1, wherein the front section includes a first mounting portion receiving the first light emitter assembly and the middle section includes a second mounting portion receiving the second light emitter assembly.

3. The luminaire of claim 2, wherein the middle section includes a side wall and an angled portion extending away from and above the first mounting portion toward the side wall.

4. The luminaire of claim 2, wherein the first light emitter assembly includes an at least one LED connected to a printed circuit board, at least one optic positioned over the LED and connected to the printed circuit board, a bezel connected to the LED, and a gasket positioned between the bezel and the printed circuit board, the gasket having edges overlapping the at least one optic and the LED board and a protrusion extending toward the bezel.

5. The luminaire of claim 4, wherein the bezel is connected to the LED board by an at least one fastener and is connected to the mounting portion by an at least one fastener.

6. The luminaire of claim 1, wherein the middle section and the front section are connected to the rear section with a first bolt and a second bolt and the first bolt and the second bolt extend through the first section, the middle section, and the rear section.

7. The luminaire of claim 6, wherein the rear section includes a first chamber having a plurality of angled walls, the first chamber receiving the first bolt and the angled walls are configured to prevent rotation of a nut threadably connected to the first bolt.

8. The luminaire of claim 1, wherein the front section includes a first set of fins and the rear section includes a second set of fins aligned with the first set of fins.

9. The luminaire of claim 1, wherein a first channel is defined by a recess extending into the first mounting portion, a second channel is defined by a recess extending into the second mounting portion, and a conductor conduit extends from the rear section through the second channel and into the first channel.

10. The luminaire of claim 9, wherein the conductor conduit is a square tubed silicone member having a first portion positioned in the first channel and a second portion positioned in the second channel.

11. The luminaire of claim 10, wherein the first portion of the silicone member includes a wire opening positioned above the second light emitter assembly.

12. A luminaire comprising:

a housing having a rear section and a removable front section, the front section including a mounting portion having a recess defining a channel and the rear section including a partition wall and an opening extending through the partition wall;

a control component positioned in the rear section;

a conductor conduit aligned with opening in the partition wall and extending into the channel; and a light emitter assembly connected to the mounting portion and operably connected to the control component by a conductor extending through conductor conduit.

13. The luminaire of claim 12, further comprising a removable middle section positioned between the front section and the rear section, and wherein a first bolt and a second bolt connect the front section, the middle section, and the rear section together.

14. The luminaire of claim 13, wherein the light emitter is connected to the front section and a second light emitter is connected to the middle section and operably connected to the control component through the conductor conduit which is in contact with a top surface of the first light emitter assembly and a top surface of the second light emitter assembly.

15. The luminaire of claim 12, further comprising a door connected to the rear section by a hinge and an at least one fastener, and wherein the door is moved from a closed position to an open position sliding the door towards the front of the housing and rotating the door about the hinge.

16. A luminaire comprising:

a housing including a rear section having a mounting feature include a first fastener boss and a second fastener boss to connect the housing to a support;

a mounting assembly having a mounting plate removably connected to the mounting feature and a mounting base removably connected to the mounting plate;

a cover connected to the mounting base; and a light emitter connected to the housing.

17. The luminaire of claim 16, wherein the mounting feature can selectively connect the housing to a roadway tenon, a round pole, or a square pole.

18. The luminaire of claim 16, wherein the mounting feature includes a second fastener boss and a third fastener boss.

19. The luminaire of claim 16, wherein a clamp having a first orientation for supporting a first sized support and a second orientation for supporting a second sized support is connected to the mounting feature.

20. The luminaire of claim 16, further comprising a curved adapter connected to the mounting base.

* * * * *